US006573479B2

(12) United States Patent
Arntz et al.

(10) Patent No.: US 6,573,479 B2
(45) Date of Patent: Jun. 3, 2003

(54) RADIAL BYPRODUCT TRAP AND FILTER ASSEMBLY FOR A COOKING APPLIANCE

(75) Inventors: Timothy J. Arntz, Cleveland, TN (US); Michael E. Bales, Cleveland, TN (US); John Scott Brown, Charleston, TN (US); Robert Z. Whipple, Jr., Loudon, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/186,671

(22) Filed: Jul. 2, 2002

(65) Prior Publication Data

US 2002/0162833 A1 Nov. 7, 2002

Related U.S. Application Data

(63) Continuation-in-part of application No. 09/983,840, filed on Oct. 26, 2001, now Pat. No. 6,417,493, which is a continuation-in-part of application No. 09/650,416, filed on Aug. 29, 2000, now Pat. No. 6,316,749.

(51) Int. Cl.[7] ..... A21B 1/26; A21B 3/04; B01D 45/08

(52) U.S. Cl. ..... 219/400; 99/469; 55/441; 55/446; 55/444

(58) Field of Search ..... 219/400; 99/469; 126/21 A; 55/440–444, 462, 464, 446

(56) References Cited

U.S. PATENT DOCUMENTS

| | | | | |
|---|---|---|---|---|
| 1,784,418 A | | 12/1930 | Catlin | |
| 3,091,171 A | | 5/1963 | Cole | |
| 3,364,664 A | | 1/1968 | Doane | |
| 3,807,144 A | * | 4/1974 | Graybill | 55/441 |
| 3,813,856 A | * | 6/1974 | Jensen | 55/444 |
| 3,827,346 A | * | 8/1974 | Tropp et al. | 219/400 |
| 3,870,494 A | | 3/1975 | Doane | |
| 4,283,209 A | | 8/1981 | Schmalhofer | |
| 4,822,385 A | * | 4/1989 | Strege et al. | 55/442 |
| 4,827,903 A | | 5/1989 | Kim | |
| 5,254,823 A | | 10/1993 | McKee et al. | |
| 5,302,174 A | | 4/1994 | Guetersloh | |
| 5,342,422 A | | 8/1994 | Wimbock | |
| 5,434,390 A | | 7/1995 | McKee et al. | |
| 5,472,342 A | | 12/1995 | Welsh, II et al. | |
| 5,558,793 A | | 9/1996 | McKee et al. | |
| 5,683,604 A | * | 11/1997 | Ubert et al. | 219/400 |
| 5,687,707 A | | 11/1997 | Prasser | |
| 6,318,245 B1 | * | 11/2001 | Durth et al. | 219/400 |

* cited by examiner

*Primary Examiner*—Joseph Pelham
(74) *Attorney, Agent, or Firm*—Diederiks & Whitelaw, PLC

(57) ABSTRACT

A quick-cook type convection cooking appliance includes an oven cavity in communication with an air channel assembly incorporating a radial byproduct trap and filter assembly defining a concentric ring-type baffle filter having two cylindrical sets of opposing air baffles. As recirculating air passes outwardly between deflectors of the baffle, the air is accelerated by a nozzle-type effect prior to impacting a center zone of an outer baffle deflector. This arrangement causes part of liquid and/or solid phases, such as grease, fats, and moisture, of the air flow to be deposited or trapped between the baffles. The air flow is then redirected back towards the inner baffle where, once again, the air impacts an inner baffle deflector that removes additional byproducts from the air. Finally, the air exits with a high uniform air flow pattern between respective deflectors of an outer baffle.

19 Claims, 7 Drawing Sheets

RADIAL BYPRODUCT TRAP AND FILTER ASSEMBLY FOR A COOKING APPLIANCE

The present application represents a continuation-in-part of U.S. patent application Ser. No. 09/983,840 filed Oct. 26, 2001, now U.S. Pat. No. 6,417,493, which is a continuation-in-part of U.S. patent application Ser. No. 09/650,416 filed Aug. 29, 2000, now U.S. Pat. No. 6,316,749.

BACKGROUND OF THE INVENTION

1. Field of the Invention

The present invention pertains to the art of cooking appliances and, more particularly, to a radial cooking byproduct trap and filter arrangement for a quick or rapid cook appliance.

2. Discussion of the Prior Art

In the art of cooking appliances, it has been heretofore proposed to enable an appliance to operate in a self-cleaning mode. For example, in a conventional range having a cooking cavity which can be heated by one or more cooking elements arranged within the cooking cavity to perform at least baking and broiling functions, it is known to operate one or more of the cooking elements to perform a pyrolytic self-cleaning operation in order to cleanse the walls of the cavity from grease and other food soils developed during normal cooking operations. In such a cooking arrangement, the cooking elements used to perform the cleaning process are located entirely within the cooking cavity.

In addition, it is known to provide a catalytic self-cleaning oven. In such an arrangement, the walls of the oven are coated with a catalytic material which provides for self-cleaning of the oven cavity during cooking operations. In performing any self-cleaning function, byproducts, including smoke, gases and other odorous fumes, are inherently produced. A typical oven cavity will be vented to permit the escape of these byproducts to the ambient surroundings. In some cases, a catalytic oxidation unit is provided in the vent to react with the flowing byproducts. In still other cooking appliance arrangements, a combination of pyrolytic and catalytic cleaning is performed.

Regardless of the fact that various self-cleaning systems have been proposed in the art, there still exists a need to further improve cleaning of a recirculating air flow in a convection cooking appliance in order to maximizes the elimination of byproducts, while also minimizing the necessary operating time for any self-cleaning mode. Particular concerns are raised in connection with the necessary operating time and byproduct elimination in a rapid cook convection oven which essentially relies on a heated flow of recirculating air and a microwave source for raising the temperature in an oven cavity.

SUMMARY OF THE INVENTION

The present invention is directed to trapping and filtering liquid and/or solid cooking byproducts for purposes of cleaning a recirculating air flow in a convection cooking appliance, particularly an appliance including an air channel assembly which is defined by ducting extending about portions of an oven cavity for directing the recirculating air flow into and out of the oven cavity. The overall system utilizes various heating elements to enhance the heating of the oven cavity, as well as the catalyst in order to enhance the efficient elimination of developed smoke, odor and other byproducts, and to effectively reduce the necessary cleaning cycle time for the appliance.

In accordance with the present invention, the convection cooking appliance particularly employs a radial byproduct trap and filter assembly for use in a quick-cook type convection cooking appliance. Specifically, the invention is concerned with using a concentric ring-type baffle filter having two cylindrical sets of opposing air deflectors or baffles. As recirculating air passes outwardly between two inner baffles, the air is accelerated by a nozzle-type effect prior to impacting a center zone of an outer baffle. This arrangement causes part of liquid and/or solid phases, such as grease, fats, and moisture, of the air flow to be deposited or trapped between the baffles. The air flow is then redirected back towards the inner set of baffles where, once again, the air impacts a baffle that leaves part of the byproducts in the air. Finally, the air exits between certain baffles of an outer baffle.

With this arrangement, the resulting separation of the liquid phase byproducts functions to deposit some of the liquid/solid byproducts onto an inside surface of an outer baffle, as well as on an outer surface of the inside ring of baffles. Symmetrical spacing of inlet and outlet or exhaust openings through each set of baffles generates a high uniform air flow pattern around the annular baffle arrangement. The overall air flow increases the effectiveness of the recirculation of the oven air system.

Additional objects, features and advantages of the present invention will become more fully apparent below with reference to a preferred embodiment of the invention, when taken in conjunction with the drawings wherein like reference numerals refer to corresponding parts in the several views.

DETAILED DESCRIPTION OF THE PREFERRED EMBODIMENT

Figure 1:
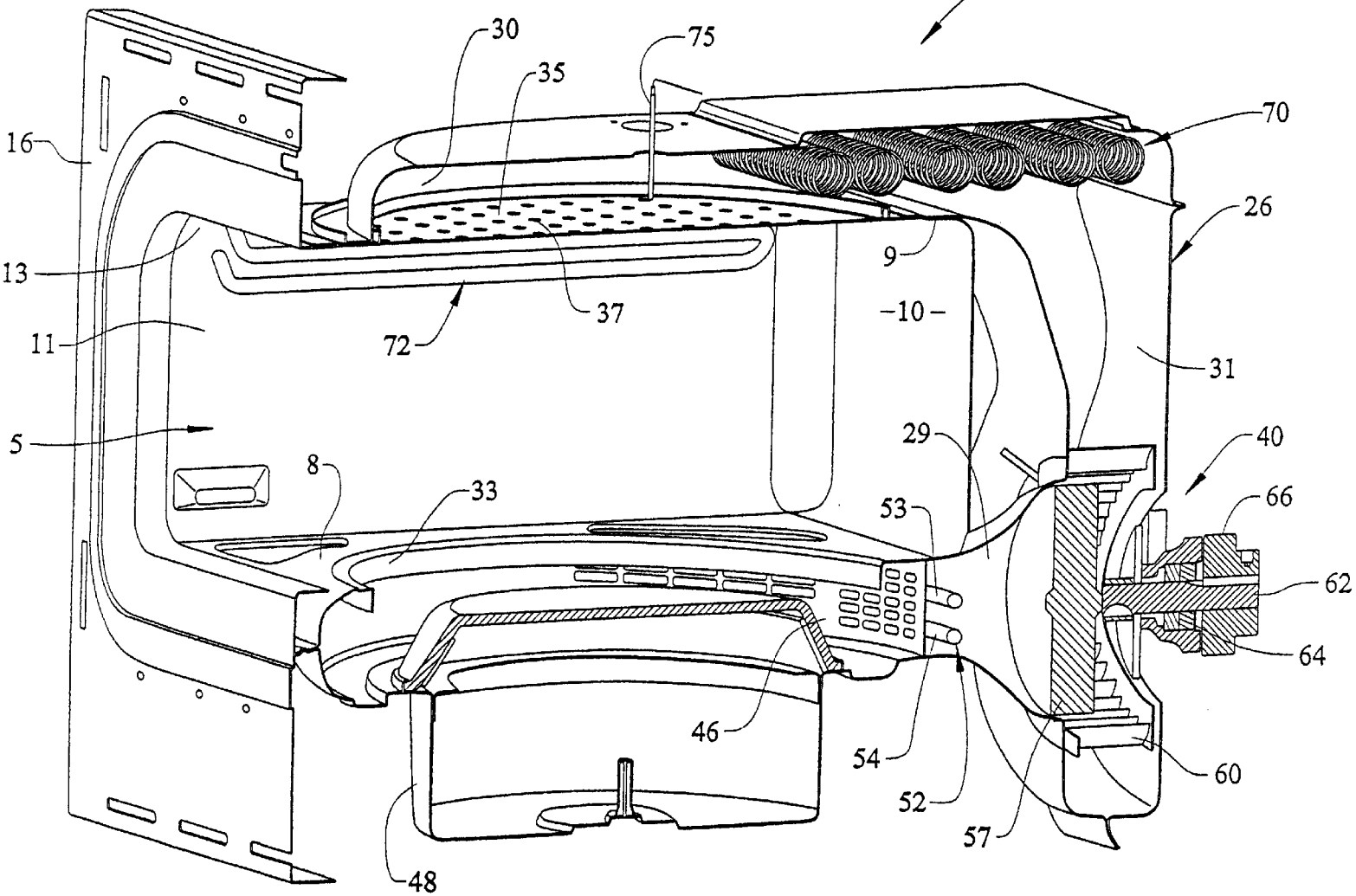
FIG. 1 is a perspective, partial sectional view of a convection cooking appliance constructed in accordance with the present invention.
Figure 2:
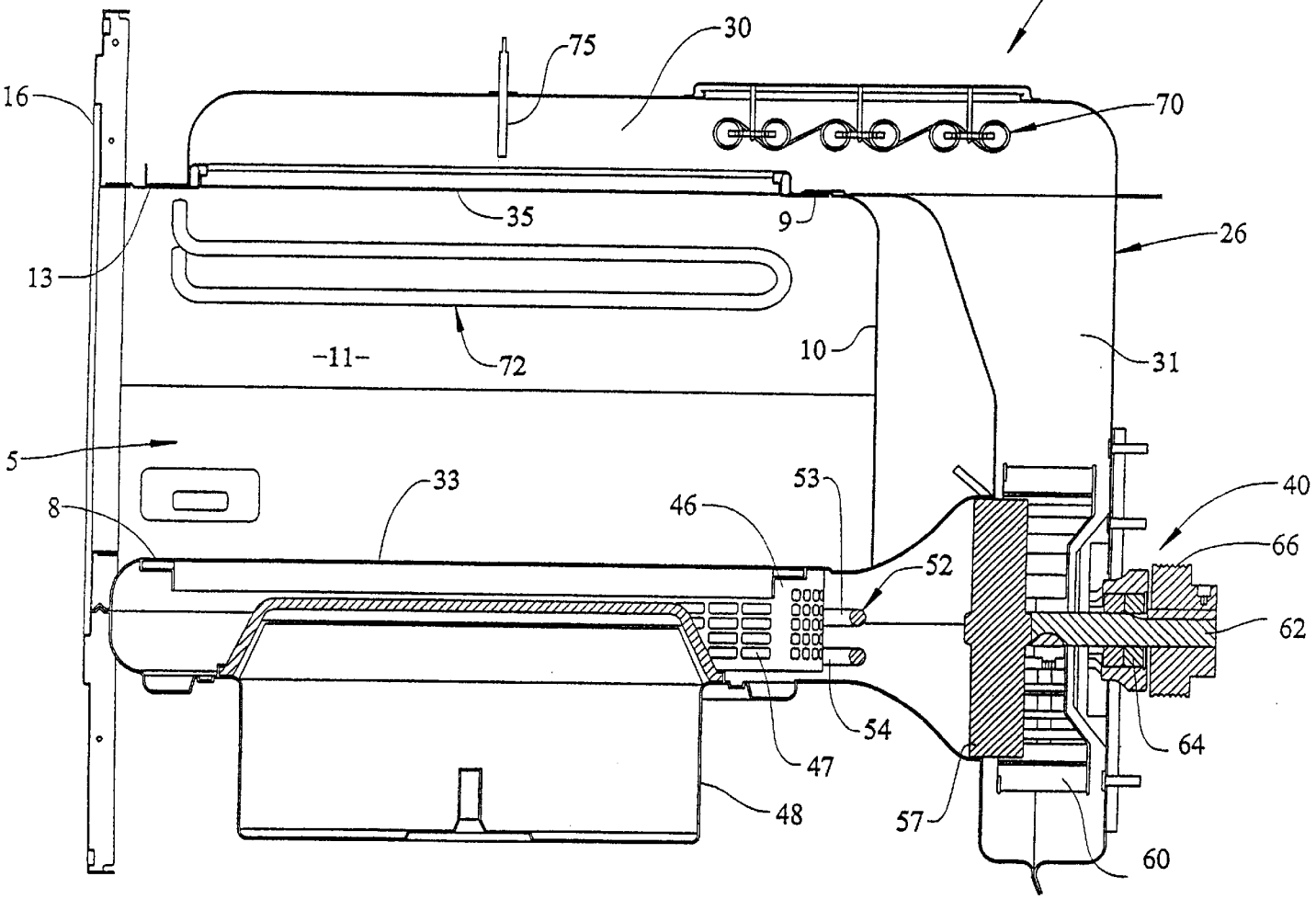
FIG. 2 is a cross-sectional side view of the cooking appliance of FIG. 1.
Figure 3:
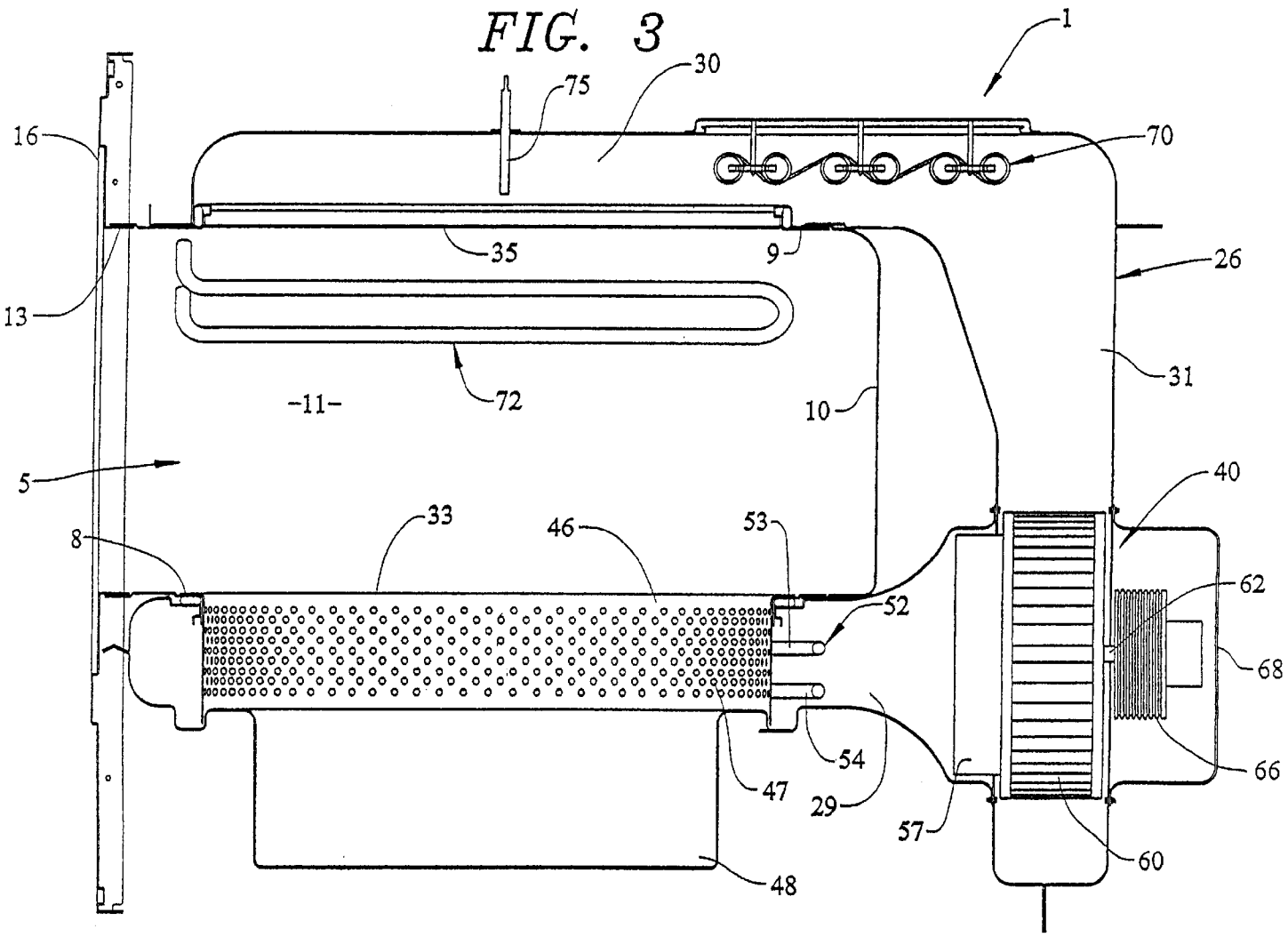
FIG. 3 is a schematic side view, similar to that of FIG. 2, of the cooking appliance.

With initial reference to FIGS. 1–3, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. However, as shown, cooking appliance 1 includes an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in U.S. Pat. No. 6,373,037 entitled "OVEN CAVITY CONSTRUCTION" which is hereby incorporated by reference.

In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron (not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. The present invention is particularly directed to the structure and operation of catalyst 57 as will be detailed more fully below. However, in general, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of heating coils. Although not pertinent to the present invention, second heating unit 70 can be defined by a single electric coil that runs back and forth across upper air delivery section 30 or multiple, separately controllable coil elements. In any event, second heating unit 70 functions to further heat the air flowing through channel assembly 26 prior to the air reaching discharge inlet 35.

Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for a cooking mode of operation is not considered to constitute part of the present invention. Instead, these details can be found in U.S. Pat. No. 6,291,808 entitled "HEATING SYSTEM FOR A COOKING APPLIANCE" which is incorporated herein by reference.

Figure 4:
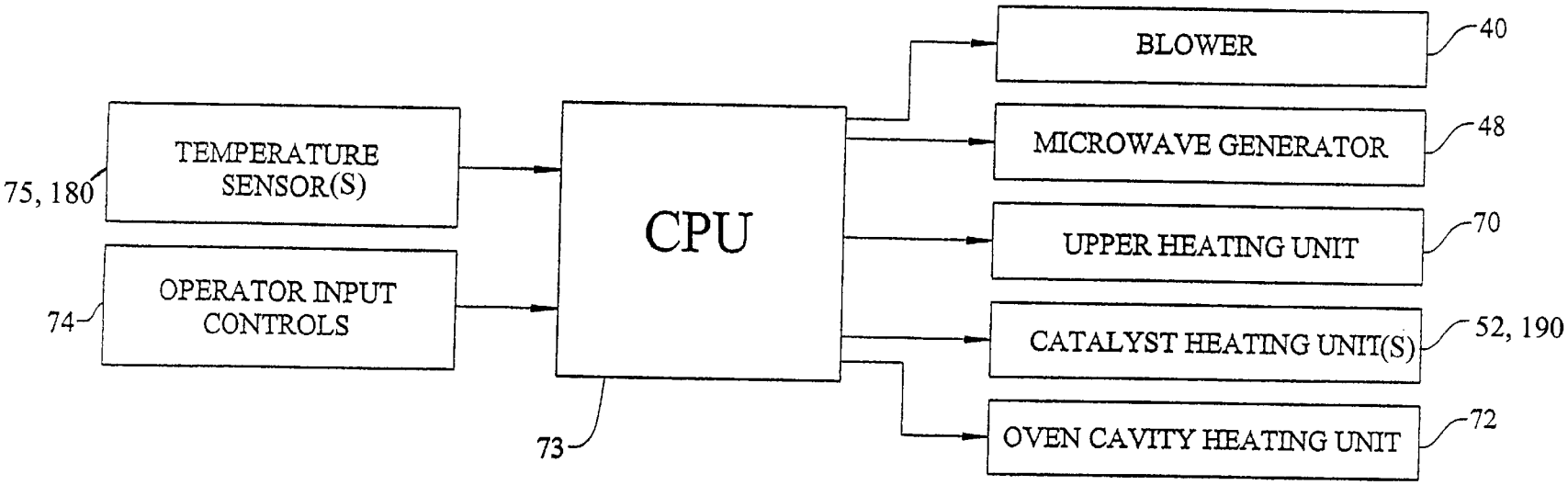
FIG. 4 is a block diagram illustrating a control arrangement used in a self-cleaning system employed in the cooking appliance of FIG. 1.

As represented in FIG. 4, each of blower assembly 40, microwave generator 48 and first, second and third electric heating units 52, 70 and 72 are linked to an appliance controller or CPU 73. Controller 73 also receives signals from operator input controls 74, as well as from a temperature sensor 75 which is preferably arranged in upper air delivery section 30, between heating unit 70 and delivery inlet 35. The present invention is particularly directed to the manner in which cooking appliance 1 is operated through a cleaning mode.

When an operator selects a cleaning mode through input controls 74, heating units 52 and 70 are initially activated, along with blower assembly 40, for preheating of oven cavity 5. At the same time, during this preheat phase, heating unit 72 is maintained deactivated. This operational stage enables the oven cavity 5 to be heated in a substantially exponential manner as represented by the portion A of the time/temperature curve shown in FIG. 5. This arrangement is designed to provide for a relatively short preheat time period, while assuring that early stage self-clean byproducts will flow to the catalyst for effective elimination. That is, it is this initial time period that substantial amounts of smoke, odors and other byproducts will be developed due to the burning off of grease and the like remaining in the oven cavity 5. By maintaining heating unit 72 deactivated, it has been found that an optimum preheat rate is established, with the temperature rise being based on the flow of heated air directed through the oven cavity 5.

Figure 5:
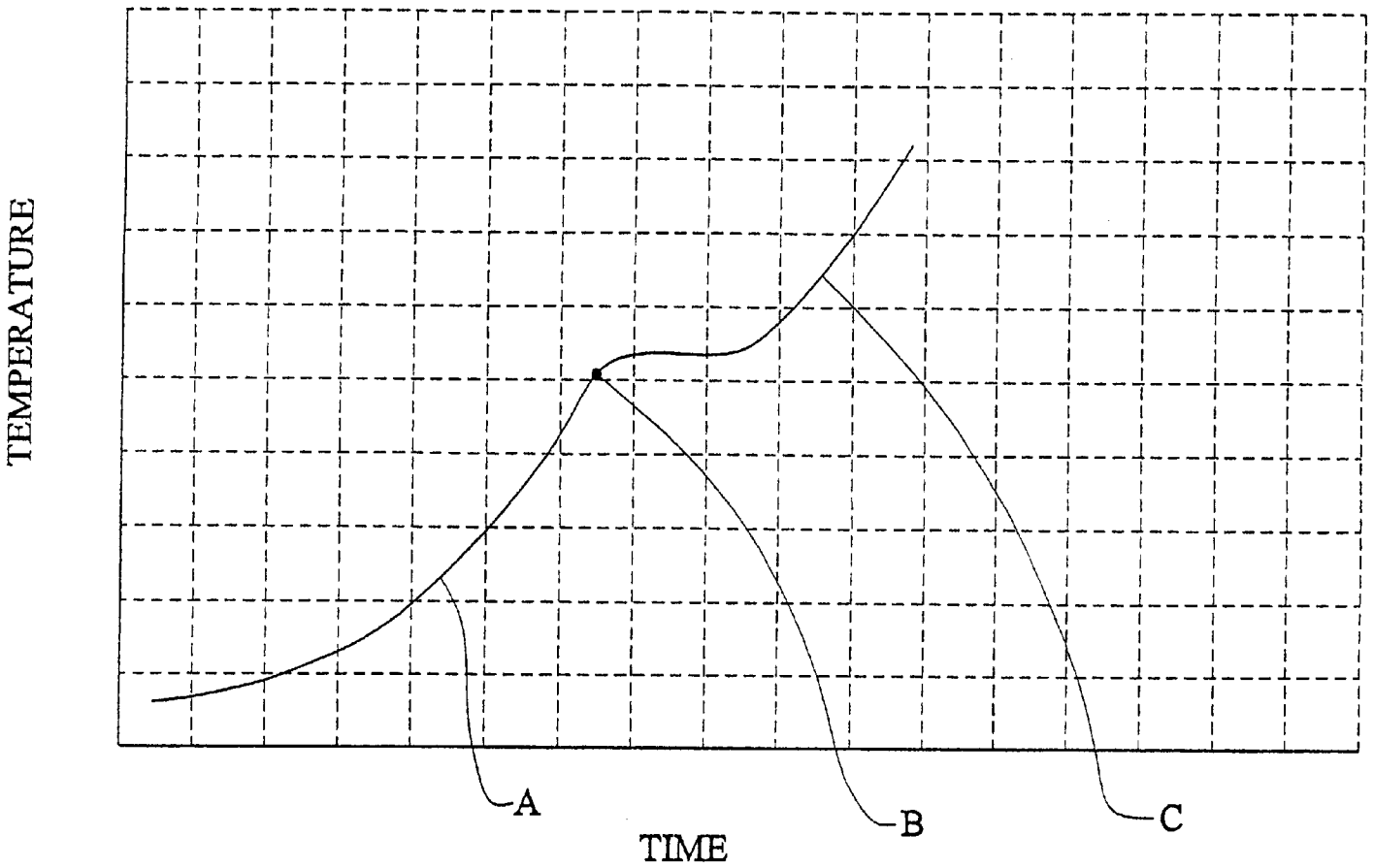
FIG. 5 depicts a graph illustrating a time versus temperature curve followed in accordance with operation of the cooking appliance during a self-clean operation.

When the temperature in oven cavity 5 reaches point B on the curve shown in FIG. 5 as conveyed through temperature sensor 75, blower assembly 40 and heating unit 70 are deactivated, while heating unit 52 remains activated and heating unit 72 in oven cavity 5 is also activated, through controller 73. With blower element 40 deactivated, the air flowing through air channel assembly 26 is based on natural convection only. This switchover phase results in a short, generally steady state time period wherein the temperature within oven cavity 5 remains substantially constant. However, electric heating unit 72 is preferably a high wattage element which rapidly heats such that the temperature within oven cavity again rises exponentially, as represented by portion C in FIG. 5. In fact, as clearly shown, portion C has an even higher associated slope than portion A. With this overall control arrangement, the preheat phase is performed at a rate which assures that the developed byproducts are effectively eliminated and vented through catalyst 57, while the subsequent rapid heating of oven cavity 5 with heating unit 72 enables the time needed to perform the overall self-cleaning operation to be minimized.

In accordance a preferred cleaning operation of cooking appliance 1, a maximum cleaning algorithm which is configured to provide maximum energy to clean oven cavity 5 plus maintain specified surface temperatures. The algorithm employs timed periods of very high thermal and forced air energy to maximize BTU delivery onto the surfaces of oven cavity 5. With this arrangement, consumption of the cooking deposits can be maximized. In general, the process is based on the chemical and thermodynamic principles that reactions increase in rate as the temperature increases.

More specifically, the self-clean algorithm starts with a catalyst heating sequence designed to eliminate smoking of various components during thermal start-up of the self-clean operation. This start-up phase directly corresponds to that described above. After the start-up phase, a moderately high presoak operation is performed to essentially burn off various light molecular weight hydrocarbons and the like. In accordance with the most preferred form of the invention, the presoak operation establishes a temperature in the order of 750° F.

In essence, the start-up and presoak phases are precursors to the main cleaning stages. In a first main stage, maximum thermal heat is applied with maximum air flow to drive the surface temperatures within oven cavity 5 to high levels. In accordance with the most preferred form of the invention, this stage operates at approximately 990° F. and a 4,800 rpm blower speed for 10 to 15 minutes. This established temperature provides the energy necessary to convert the majority of the cooking byproducts into water and carbon dioxide.

Following this first main stage, a timed cool down sequence is employed. In this cool down stage, the thermal input is reduced, preferably to approximately 930° F. which represents a desired minimum cleaning temperature, and the air flow is reduced. Most preferably, the air flow is reduced in half by decreasing the speed of blower assembly 40 to approximately 2,400 rpm. With this arrangement, thermal heating/time relationships are used to minimize the effects of the first main cleaning stage. This cool down stage is preferably maintained for in the order of 10 to 15 minutes.

The cool down stage is followed by an intermediate high temperature and blower timed stage. Most preferably, the established temperature for this stage is approximately 960° F., with a blower speed of 3,600 rpm. This stage is preferably preset for 10 minutes and is followed by a repeat of the cool down or cooling stage as set forth above. Thereafter, this intermediate high temperature and blower timed stage and following cool down stage combination is continuously repeated until the total self-clean time set by the user is completed.

Figure 6:
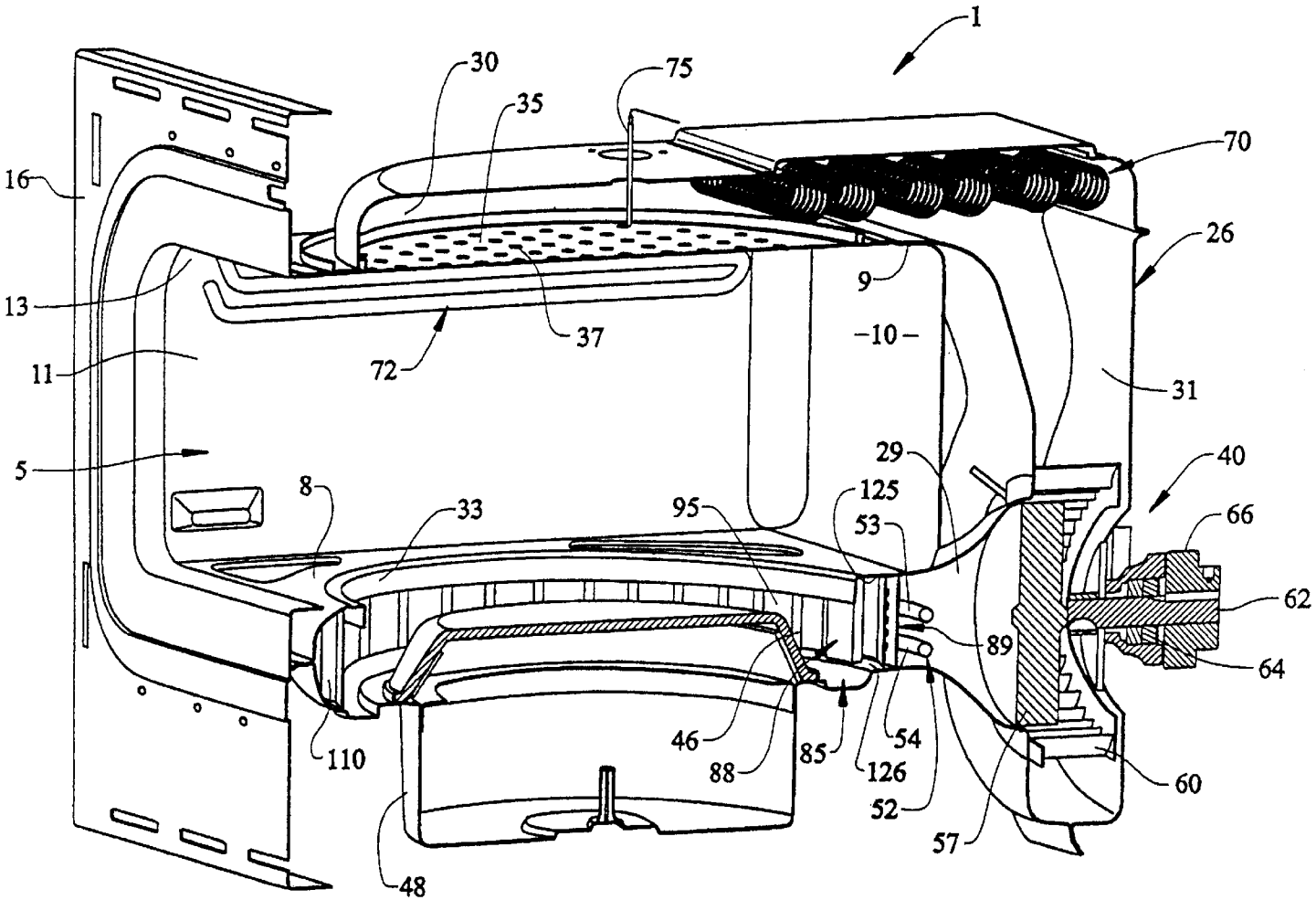
FIG. 6 is a perspective, partial cross-sectional view corresponding to that of FIG. 1, while depicting a radial trap and filter arrangement incorporated into the cooking appliance in cross-section.
Figure 7:
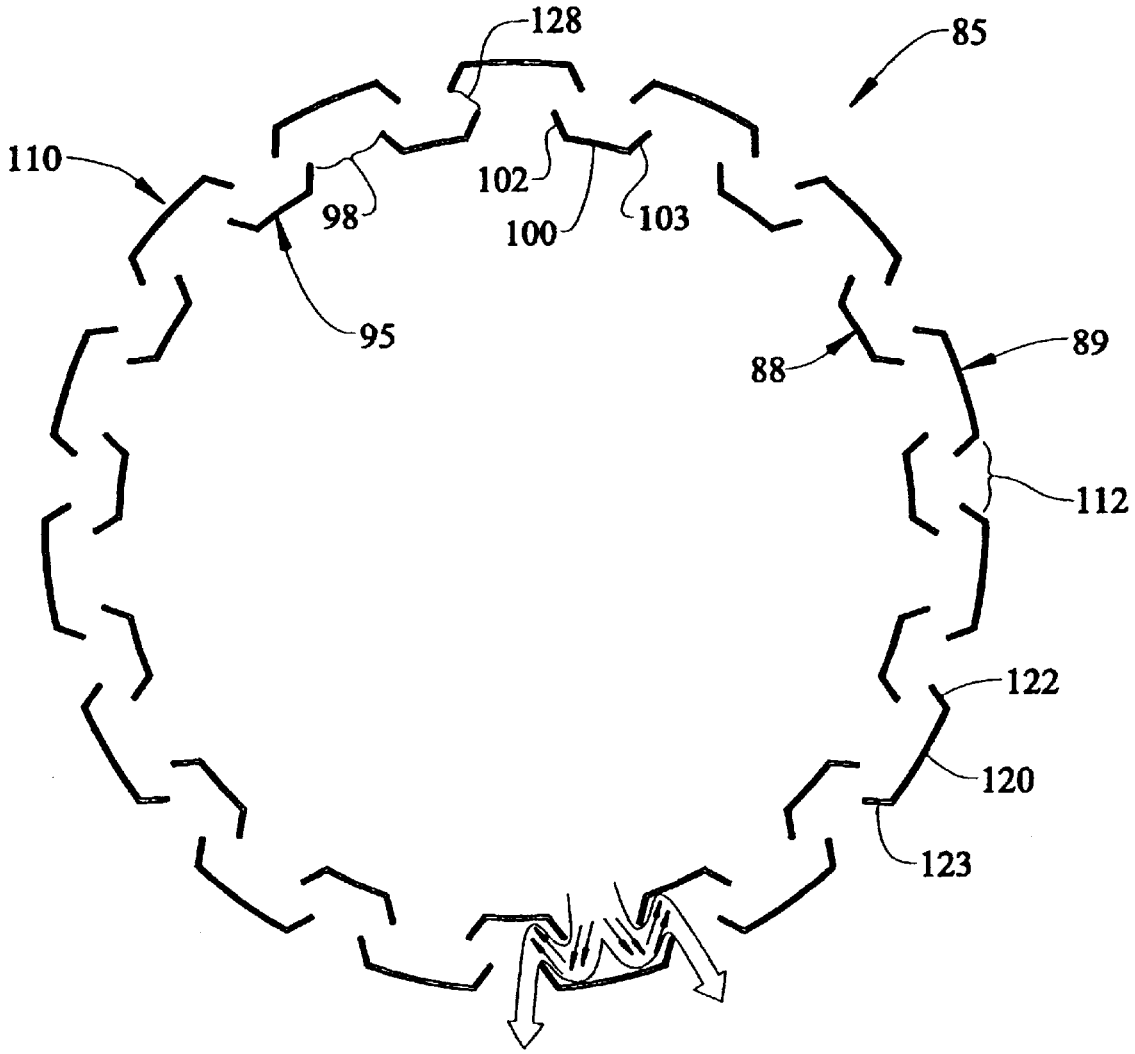
FIG. 7 is an enlarged cross-sectional view of the radial trap and filter arrangement of FIG. 6.

Even if a dedicated, self-cleaning cycle is employed, it is still desirable to cleanse an air flow which recirculates during the operation of convection cooking appliance 1. To this end, in accordance with the present invention, cooking appliance 1 incorporates a trap and filter unit 85, as shown in each of FIGS. 6 and 7, for trapping and filtering liquid and/or solid cooking byproducts from a recirculating air flow. In the most preferred form of the invention, trap and filter unit 85 is used in place of filter basket 46 and constituted by a concentric ring-type baffle filter element including inner and outer, concentric, generally cylindrical air baffles 88 and 89. Inner air baffle 88 is composed of a plurality of annularly spaced inner deflectors 95 which are spaced by inner, air inlet gaps 98. Each inner deflector 95 includes a radially innermost base portion 100 and angled first and second end portions 102 and 103. Each of first and second end portions 102 and 103 preferably projects radially outward at an angle in the range of 30–60°, most preferably about 45°, from base portion 100.

In a similar manner, outer air baffle 89 is composed of a plurality of annularly spaced outer deflectors 110 which are spaced by outer, air exhaust gaps 112. Each outer deflector 110 includes a radially outermost base portion 120 and angled first and second end portions 122 and 123. Each of first and second end portions 122 and 123 preferably projects radially inward at an angle in the range of 30–60°, most preferably about 45°, from base portion 120. Inner and outer baffles 88 and 89 are interconnected by upper and lower rings 125 and 126. As shown, each outer deflector 110 spans and annularly overlaps the inlet gap 98 between respective, adjacent inner deflectors 95. In fact, each base portion 120 preferably has a length which is greater than each inlet gap 98.

Therefore, first and second end portions 122 and 123 are located within the confines of respective, juxtapose inner deflectors 95. At the same time, each of first and second end portions 122 and 123 is both annularly and radially spaced from a respective first and second end portion 102, 103 so as to define internal openings or gaps 128.

With this construction, as recirculating air passes outwardly through the inlet gap 98 between two inner baffles 88, the air is accelerated by a nozzle-type effect prior to impacting a center zone of base portion 120. This arrangement causes part of liquid and/or solid cooking byproducts, such as grease, fats, and moisture, of the air flow to be deposited or trapped on the outer baffles 89. The air flow is then redirected back towards the inner baffles 88 where, once again, the air impacts a respective base portion 100 in order to separate part of the byproducts from the remainder of the air flow. Therefore, the redirection of the air flow causes a rapidly reduced air velocity between baffles 88 and 89 which occurs faster than heavy cooking byproducts, including liquid fats and moisture, can respond. Instead, these heavy byproducts get deposited at the base portions 100 and 120 as discussed above. Finally, the air is led to a respective outlet gap 112 where the recirculating air exits trap and filter unit 85. In this manner, the air takes a generally serpentine or sinusoidal path through trap and filter unit 85.

With this arrangement, the resulting separation of the liquid phase byproducts functions to deposit some of the liquid/solid byproducts onto the inside surfaces (not labeled) of outer baffles 89, as well as on the outer surfaces (not labeled) of inner baffles 88. Inlet and outlet or exhaust gaps 98 and 112 are symmetrically located so as to generate a high uniform air flow pattern around the overall baffle arrangement. The overall air flow increases the effectiveness of the recirculation of air through air channel assembly 26, as well as oven cavity 5. Of course, any collected byproducts will be subjected to the high heat levels discussed above during self-clean cycles. If desired, trap and filter unit 85 can be removed for cleaning or replacing.

Although described with respect to a preferred embodiment of the invention, it should be readily understood that various changes and/or modifications can be made to the invention without departing from the spirit thereof. For instance, although trap and filter unit 85 is stated to replace filter basket 46, it is possible to utilize these components in combination, with trap and filter unit 85 being arranged either radially inwardly or outwardly of filter basket 46. In any event, the invention is only intended to be limited by the scope of the following claims.

We claim:

1. A convection cooking appliance comprising:

an oven cavity;

an air channel assembly extending about at least a portion of and being in fluid communication with the oven cavity;

a blower element for developing a flow of air within the air channel assembly and through the oven cavity;

at least one heating unit for heating the flow of air; and a trap and filter unit including inner and outer radially concentric air baffles located within the air channel assembly, said inner baffle including a plurality of annularly spaced inner deflectors which are spaced by air inlet gaps, said outer baffle including a plurality of annularly spaced outer deflectors which are spaced by air outlet gaps, each said outer deflectors being radially spaced from and annularly overlapping respective ones of said inner deflectors, wherein the flow of air is directed into the inlet gaps, against respective ones of the outer deflectors whereupon cooking byproducts in the flow of air are deposited on the outer deflectors, subsequently against respective ones of the inner deflectors to separate further cooking byproducts from the flow of air, and through the outlet gaps.

2. The cooking appliance according to claim 1, wherein each of the outer deflectors includes a base portion and first and second end portions, wherein said first and second end portions project radially inward from the base portion.

3. The cooking appliance according to claim 2, wherein each of the first and second end portions projects radially inward from the base portion at an angle in the range of 30–60°.

4. The cooking appliance according to claim 3, wherein each of the first and second end portions project radially inward from the base portion at an angle of approximately 45°.

5. The cooking appliance according to claim 2, wherein the base portion of each outer deflector has a length which is greater than a respective one of the inlet gaps.

6. The cooking appliance according to claim 1, wherein the inner and outer baffles define a serpentine flow path through the trap and filter unit.

7. The cooking appliance according to claim 1, further comprising: a microwave generator adapted to direct microwaves into the oven cavity.

8. The cooking appliance according to claim 7, wherein the microwave generator is arranged concentrically below the trap and filter unit.

9. A convection cooking appliance comprising:

an oven cavity;

an air channel assembly extending about at least a portion of and being in fluid communication with the oven cavity;

a blower element for developing a flow of air within the air channel assembly and through the oven cavity;

at least one heating unit for heating the flow of air; and a trap and filter unit including inner and outer radially concentric air baffles located within the air channel assembly, said inner baffle including a plurality of annularly spaced inner deflectors which are spaced by air inlet gaps, said outer baffle including a plurality of annularly spaced outer deflectors which are spaced by air outlet gaps, each of the inner and outer deflectors including a base portion and first and second angled end portions, said first and second angled end portions of the inner deflectors project radially outward, while said first and second end portions of the outer deflectors project radially inward, wherein the inner and outer baffles define a serpentine path for the flow of air through the trap and filter unit.

10. The cooking appliance according to claim 9, wherein each of the first and second angled end portions projects radially inward from the base portion at an angle in the range of 30–60°.

11. The cooking appliance according to claim 10, wherein each of the first and second angled end portions project radially inward from the base portion at an angle of approximately 45°.

12. The cooking appliance according to claim 9, wherein the base portion of each outer deflector has a length which is greater than a respective one of the inlet gaps.

13. The cooking appliance according to claim 9, further comprising: a microwave generator adapted to direct microwaves into the oven cavity.

14. The cooking appliance according to claim 13, wherein the microwave generator is arranged concentrically below the trap and filter unit.

15. A method of cleaning a recirculating air flow in a convection cooking appliance including an oven cavity, at least one heating element and a blower for generating the air flow inside an air channel assembly leading to and from the oven cavity comprising:

guiding the air flow, containing cooking byproducts, from the oven cavity to a trap and filter unit positioned in the air channel assembly;

directing the air flow to impact an outer radial baffle of the trap and filter unit to cause cooking byproducts in the air flow to be deposited on the outer baffle;

redirecting the air flow to cause the air flow to impact an inner radial baffle of the trap and filter unit to cause additional cooking products in the air flow to be deposited on the inner baffle; and further redirecting the air flow radially outward to exit the trap and filter unit.

16. The method of claim 15, further comprising: accelerating the air flow through a nozzle effect prior to the air flow impacting the outer radial baffle.

17. The method of claim 15, further comprising: establishing a high uniform air flow pattern within the trap and filter unit.

18. The method of claim 15, further comprising: rapidly reducing a velocity of the air flow upon impact with each of the inner and outer radial baffles to cause heavy liquid and solid byproducts to be deposited on deflectors defining the inner and outer radial baffles respectively.

19. The method of claim 15, further comprising: causing the air flow to follow a serpentine path about and between deflectors which form the inner and outer radial baffles.

* * * * *